United States Patent [19]

Seki et al.

[11] 4,402,158

[45] Sep. 6, 1983

[54] TOY EMPLOYING GOVERNOR TO CONTROL RATE OF MOVEMENT OF MOVABLE MEMBER

[75] Inventors: Yoshizo Seki, Tokyo, Japan; Saburo Watanabe, Gardena, Calif.

[73] Assignee: Tomy Corporation, Carson, Calif.

[21] Appl. No.: 230,852

[22] Filed: Feb. 2, 1981

[30] Foreign Application Priority Data

Feb. 9, 1980 [JP] Japan ..... 55-15029

[51] Int. Cl.[3] ..... A63H 11/10; F16J 3/04

[52] U.S. Cl. ..... 46/44; 46/104; 46/135 R; 92/40

[58] Field of Search ..... 46/44, 119, 120, 129, 46/135 R, 145; 92/34, 40

[56] References Cited

U.S. PATENT DOCUMENTS

| | | | |
|---|---|---|---|
| 1,673,772 | 6/1928 | Middleton | 46/129 |
| 1,740,172 | 12/1929 | Hagemo | 46/120 |
| 2,680,329 | 6/1954 | Wigal | 46/129 X |
| 2,885,824 | 5/1959 | Lemelson | 46/129 |
| 2,901,862 | 9/1959 | Thomas | 46/119 |
| 2,952,460 | 9/1960 | Ellis | 46/129 X |
| 3,501,861 | 3/1970 | Goldfarb et al. | 46/129 |

*Primary Examiner*—F. Barry Shay

*Attorney, Agent, or Firm*—K. H. Boswell; Edward D. O'Brian

[57] ABSTRACT

A toy has a housing in which is movably mounted a primary movable member. The primary movable member moves from a first position to a second position. The toy includes a first mechanism for moving the primary movable member from the first position to the second position and a second mechanism which moves the primary movable member from the second position to the first position, while concurrently governing the rate of the movement from the second position to the first position. Associated with the primary movable member are one or more secondary movable members. The secondary movable members are capable of moving between two positions in response to movement of the primary movable member between its first and second position. When more than one secondary movable member is included, as the primary movable member moves from the second position to the first position, the secondary movable members are sequentially moved.

10 Claims, 14 Drawing Figures

34
14
32
10
100
114
102
42
40
16
38
122
130
104
112
110
89
86
90
132
96
124
134
136
92
94
156
88
152
26
82
98
144
126
138
154
140
146
202
12
204
184
148
30
200
28
198
188
182
178
176
172

34
14
32
10
114
44
18
100
102
130
50
122
20
132
48
89
110
22
46
90
124
62
134
86
52
60
136
118
24
126
58
54
120
128
56
108
12
138
206
202
184
192
186
198
188
28
194
190
196
36

34
14
32
114
10
100
50
102
130
20
122
86
48
104
132
62
6422
106
110
72
116
92
68
66
74
94
138
70
76
140
84
12
142
80
82
206
78
36
28

TOY EMPLOYING GOVERNOR TO CONTROL RATE OF MOVEMENT OF MOVABLE MEMBER

BACKGROUND OF THE INVENTION

This invention is directed to a toy which includes a primary movable member movable between a first and second position. Movement from the second position back to the first position is under the influence of a governor which limits the rate of said movement.

Certain toys are constructed so as to include one or more movements of parts of the toys. Included in this group of toys would be toys which characterize animals and/or humans such as dolls and animated toy figures. In the past movable portions of dolls have been restricted to such anatomical features, such as movement of the eyelids, the eyeballs, or the lower lip and chin. In characterized animal figurines, more complex movement has been included, such as mechanical movement of arms and legs and the like.

It is normal practice in manufacturing toys as discussed in the preceding paragraph to try and mimick certain functions of the real life counterpart of the toy. Thus, in dolls, eyelids are made to open and close as the doll is moved from a generally vertical position to a horizontal position, or a tongue, arm or other appendage is made to reach out and retract upon activation of a button or the like.

In other types of toys, such as animated animals, the incorporation of a small spring-wound or electrical motor has resulted in animation of the appendages of the toy upon activation of the motor. Normally in these types of toys motion of the appendages is achieved by incorporating a crank shaft and linking rods linking the appendages to the crank shaft to propel the appendages. In this type of toy, motion is either an all or nothing type of affair-that is, either all of the appendages are working simultaneously or all of them are in an off mode.

In all of the dolls and characterized or motorized animals discussed above, motion of the components of the toy is essentially instantaneous on either reclining or raising the doll, or winding a spring, or moving a button to an on position and the like. Very few toys are known which incorporate delay-type motions. By this it is meant the operator of the toy effects a certain movement motion or the like to the toy, and after a delayed response period seemingly unassociated with the original command motion, the toy then performs an act. One such toy of the immediately described class is found in U.S. Pat. No. 3,287,847. In this toy which incorporates a suction cup within the interior of a doll, when the doll is reclined in a horizontal position and its body is bent with respect to its legs, a suction cup engages an internal surface of the toy. The seal between the suction cup and the surface of the toy is not perfect such that after a delayed response period, the suction force is lost between the suction cup and the surface of the toy and the suction cup is released from said surface. Upon release of the suction cup the toy bends about the hip joints bringing the torso in about a 90° angle with respect to the legs. In this toy then, the child performs one function and the doll, after a delayed response period, responds to that function.

While the above described doll found in U.S. Pat. No. 3,287,847 incorporates a delayed response, the expression of the response is a single act; that is, the doll executes one movement in response to the delay action mechanism incorporated in the doll. It is considered that toys which were able to accomplish several delayed actions, or a sequence of delayed actions, would find considerable play value in using the same. Further, in the preschool age recipient of toys, such delayed action can be very entertaining in that it seems mysterious and unaccounted for, and therefore contributes to the play value of the toy and its ability to hold the interest of the child for a long period of time.

BRIEF SUMMARY OF THE INVENTION

In view of the preceding, it is considered there exists a need for a toy, especially a toy directed to preschool age children, which is capable of performing several movements in a sequential manner. It is further considered that such a toy should also incorporate means totally under the control of the child to activate the toy. This ensures an active play role of the child in using the toy and not simply one of a spectator role. In view of these needs, it is therefore a broad object to provide a toy which is capable of performing a series of sequential motions in response to a single command from the user of the toy. It is a further object to provide a toy which employs simplicity of construction and therefore efficiency and economy in manufacturing and designing the same. Additionally, it is an object to provide a toy which, because of its simplicity of construction and operation, is durable in use and can be manufactured and sold to the public at a reasonable cost.

These and other objects are achieved by providing a toy which comprises a housing; a primary movable means movably mounted on said housing and movable between a first position and a second position; a first means operatively associated with said primary movable means and capable of moving said primary movable means from said first position to said second position; a second means operatively associated with said primary movable means and capable of moving said primary movable means from said second position to said first position and concurrently governing the rate of movement from said second position to said first position, said second means independent of said first means; at least one secondary movable means mounted on said housing in operative association with said primary movable means and movable from an initial position to a subsequent position in response to movement of said primary movable means from its first position to its second position and from said subsequent position to said initial position in response to movement of said primary movable means from its second position to its first position.

The secondary movable means can include a biasing means capable of moving the primary movable means from the second position to the first position, and also a governing means capable of concurrently governing the rate of the movement of said primary movable means as it moves from said second position to the first position. Further, additional secondary movable means can be mounted on the housing. Each of the secondary movable means would be operatively associated with the primary movable means and each of them would be movable from an initial position to a subsequent position in response to movement of the primary movable means from its first position to its second position. When the primary movable means moves from its second position back to its first position each of the secondary movable means would move independently and sequentially from their subsequent positions to their initial positions.

Preferredly the governing means would include a bellows means having an imperforate expandable bellows body which is capable of being attached at either end. One of the ends would be attached to the housing and the other of the ends would be operatively attached to the primary movable means. The bellows means would include an opening which connects the interior of the bellows body to the ambient environment. The opening would preferredly have a surface positioned around the total periphery of the opening. This surface would include a large multiplicity of irregular convolutions such that a flexible membrane could be positioned directly associated with said surface and only partially seal against the convolutions on the surface. This allows for passage of a fluid, preferredly a gas such as air, from the ambient environment within the housing between the convoluted surface and the membrane at a controlled rate to controllably allow fluid to enter the interior of the bellows body. The controlled rate of fluid to the interior of the bellows body would allow for controllable expansion of the bellows body and thus controllable expansion of the bellows means. The controlled rate would depend on the size and placement of the convolutions on the surface. Exceedingly rough surface would offer more fluid passageways between the surface and the membrane, while a smoother surface would allow for less fluid passage, and thus slower expansion of the bellows body.

Preferredly the first means comprises an actuator means movably mounted on the housing and having a portion of which is exposed outside of the housing in a position such that the operator of the toy can engage such portion and impart motion to the actuator means. The motion from the actuator means is transferred to the primary movable means causing the primary movable means to move from the first position to the second position in response to the motion imparted to the actuator means by the operator of the toy.

At least a portion of the plurality of the secondary movable means would comprise movable extendable members movably mounted in the housing. Preferredly, these members would mimick certain anatomical appendages of a characterized animal such as the nose, tongue, etc. These movable extendable members would move from an extended position wherein they are generally extended out of the housing to a retracted position wherein they are generally retracted in the housing upon movement of the primary movable means from its first position to its second position, and then as the primary movable means moves from the second position to the first position, the movable extendable members would sequentially move from their retracted position to their exposed position. Thus, in operation, as the primary movable member moves from the second position to the first position, an extendable member such as a tongue would extend out of the mouth of a characterized animal.

BRIEF DESCRIPTION OF THE DRAWINGS

This invention will be better understood when taken in conjunction with the drawings wherein.

Figure 1A:
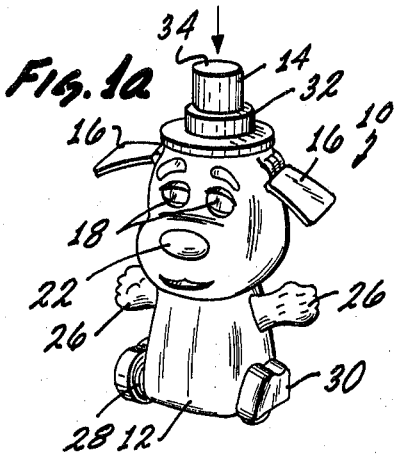
FIG. 1 is a progressive series of isometric views of the toy from FIGS. 1*a* through 1*f* showing movement of individual components of the toy.
Figure 1B:
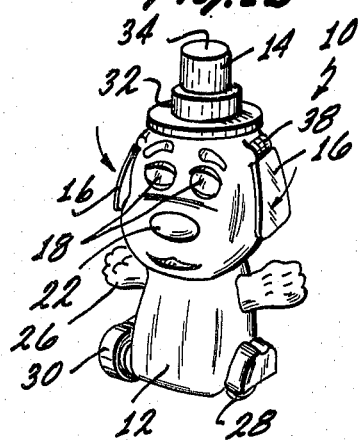
Figure 1C:
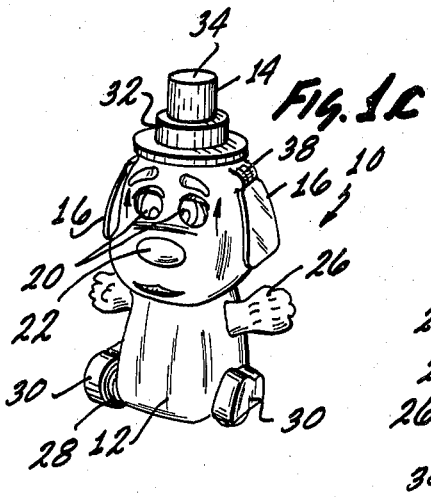
Figure 1D:
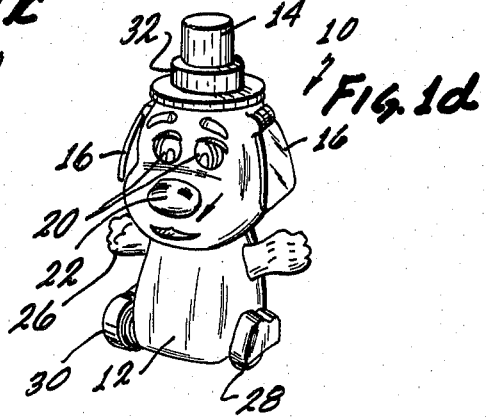
Figure 1E:
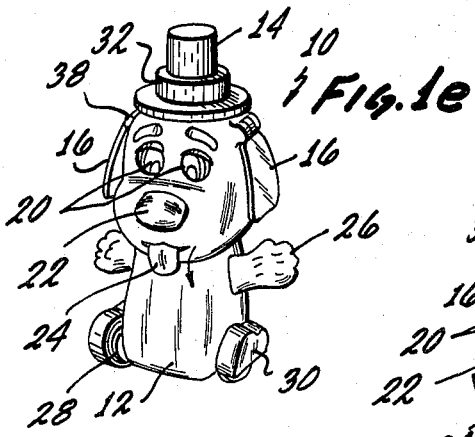
Figure 1F:
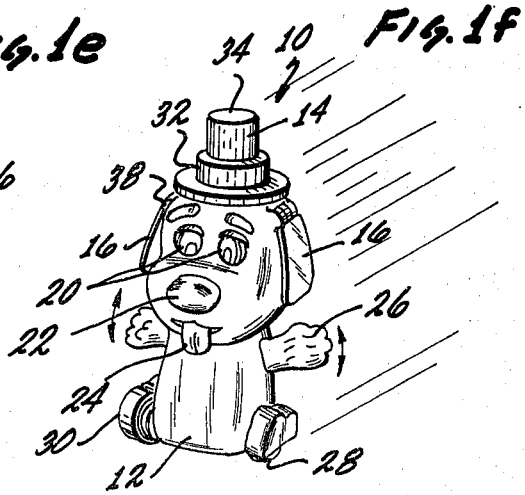

This invention utilizes certain principles and/or concepts as are set forth in the claims appended to this specification. Those skilled in the toy art will realize that these principles and/or concepts can be expressed in a number of different ways in seemingly differently appearing embodiments. For this reason, this invention is not to be construed as being limited to the exact embodiment used herein for illustrative purposes, but is to be construed only as being limited to the claims appended hereto.

DETAILED DESCRIPTION

The toy 10 of the invention is generally shaped as a characterized animal and as shown in the drawings preferredly as a characterized dog. Externally, the toy 10 includes a body 12 having a hat 14, ears collectively identified by the numeral 16, eyelids collectively identified by the numeral 18, eyes collectively identified by the numeral 20, a nose 22, a tongue 24, upper limbs collectively identified by the numeral 26, activator wheels 28, and lower limbs collectively identified by the numeral 30. Before describing the mechanics of the toy, a brief description of how it works will aid in understanding the invention.

The toy 10 is placed on a support surface. The child playing with the toy depresses the hat 14. This causes the ears 16 to raise up from the toy 10, the eyelids 18 to close over the eyes 20, the nose 22 to retract into the toy 10, and the tongue 24 to retract into the toy 10. When the child releases the hat 14 sequentially as depicted in FIG. 1, the following events happen. First, the ears 16 descend downwardly. Next, the eyelids 18 open up exposing the eyes 20. This is followed by the nose 22 projecting out of the toy 10. Next, the tongue 24 projects out of the toy 10, and finally the drive wheels 28 are activated propelling the toy 10 forward while concurrently causing the upper limbs 26 to oscillate up and down, and the lower limbs 30 to also oscillate up and down over the drive wheels 28. The toy 10 will continue to move across its support surface until a spring motor as hereinafter described is wound down, at which time the toy 10 will stop. The toy 10 is now in position for the child to once again depress the hat 14 to start the sequence of events over.

The body 12 of the toy 10 is composed of a front and back housing member (not separately identified or numbered) which are joined together by appropriate screws which fit into appropriate holes in appropriate hollow bosses (none of which are separately identified or numbered) which join the housing sections together. On the top of the body 12 is an annular housing member 32 which forms the brim portion of the hat 14. The crown portion of the hat 14 is an activator button 34 which is movable within the housing member 32. A second set of wheels, collectively identified by the numeral 36, combine with the drive wheels 28 in supporting the toy 10 on a surface.

The ears 16 are hinged to the body 12 via axles collectively identified by the numeral 38 which fit into bearing surfaces 40 formed on each of the ears 16 and are appropriately journaled to the housing portions of body 12 in a usual manner. This allows the ears 16 to move between the two positions shown in solid and phantom lines on the left-hand side of FIG. 2. Projections, collectively identified by the numeral 42, are appropriately formed as a part of the ears 16 and are located within the interior of the body 12. As will be hereinafter explained, interactions of the projections 42 with other parts as hereinafter identified cause the ears to flop up and down as seen in comparing FIGS. 1*a* and 1*b*.

Figure 3:
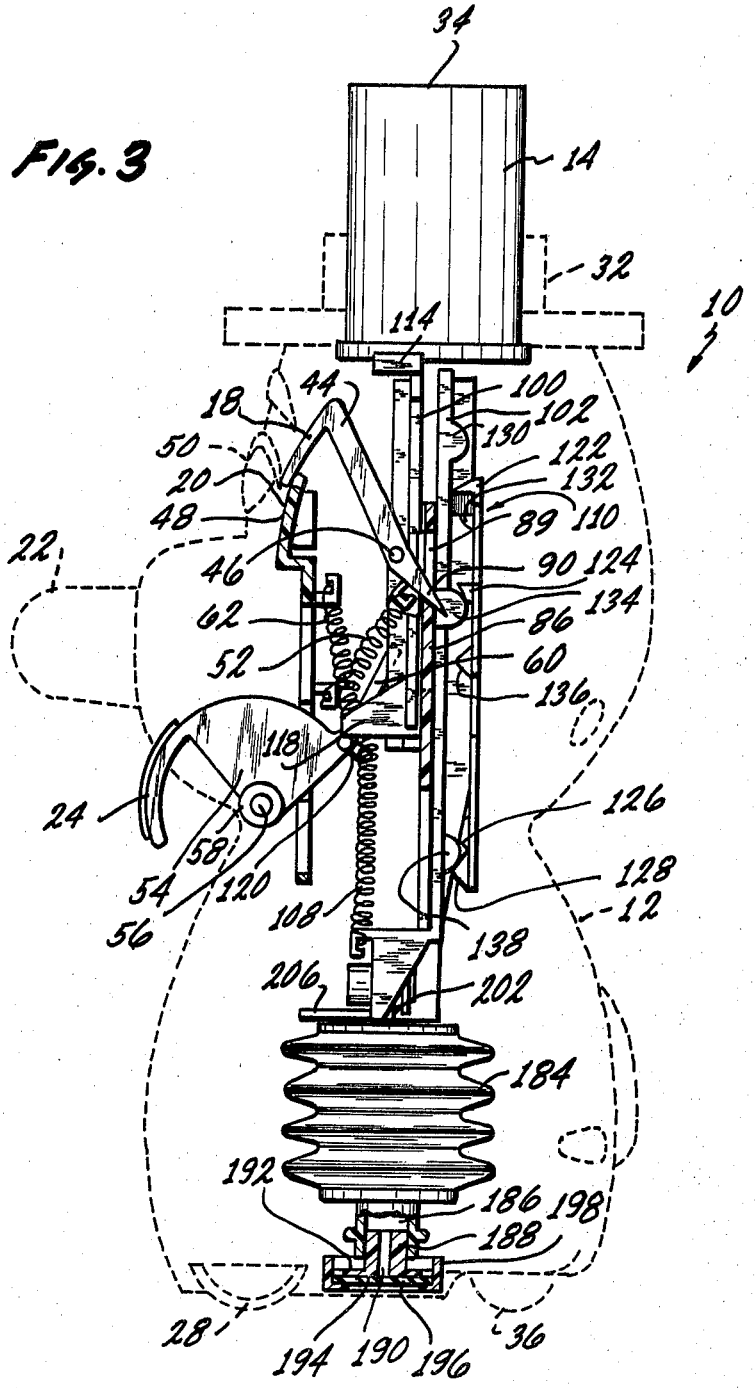
FIG. 3 is a partial side elevational view in partial section of the toy of FIG. 2 as viewed from the left-hand side and showing certain of the components in a first spatial relationship.
Figure 4:
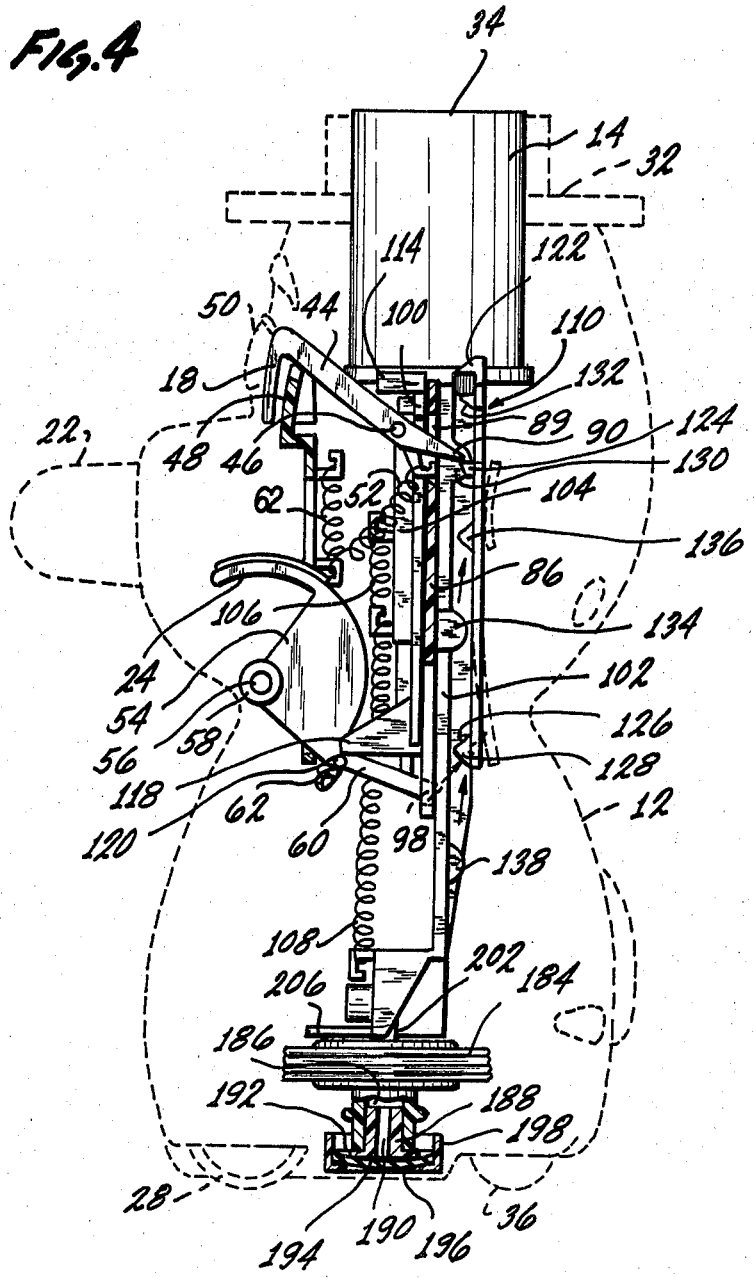
FIG. 4 is a side elevational view in partial section showing the same view as FIG. 3 except that certain of the components are shown in a different spatial relationship than as shown in FIG. 4.

Referring to FIGS. 3 and 4, it can be seen that the eyelids 18 are in fact a part of member 44 which is pivotally mounted within the interior of body 12 via axles collectively identified by the numeral 46. The axles 46 are appropriately journaled within bearing surfaces (not identified or numbered) formed within the housing parts forming body 12. A member 44 moves between the two positions shown in FIGS. 3 and 4. A plate 48 is located within the interior of the body 12 and is appropriately mounted by a screw to one of the housing members forming body 12. The eyes 20 are in fact indicia printed on the surface of plate 48 which is exposed through the eye sockets 50 within the body 12. The sections of the member 44 forming the eyelids 18 come between the plate 48 and the eye sockets 50 in FIG. 4 when the eyes are closed, and this same section is lifted up to expose the eyes 20 through the eye sockets 50 as seen in FIG. 3 when the eyes are opened. A spring 52 attaching between plate 48 and eyelid member 44 biases the member 44 into the position shown in FIG. 3. Movement of the member 44 into the position shown in FIG. 4 will be discussed hereinafter.

The tongue 24 is part of member 54 which is arcuate in shape as is seen in FIGS. 3 and 4. The member 54 is pivotally attached to the housing components of body 12 by axle 56 which passes through bearings 58 formed as a part of the member 54. The axle 56 further passes through appropriate journals in the housing components forming the body 12. This allows the member 54 and the tongue 24 attached thereto to pivot such that the tongue 24 can be extended outside of the body 12 as is seen in FIG. 3, or retracted into the body 12 as is seen in FIG. 4. At the end of the arcuate sector opposite where tongue 24 is mounted is an extension 60 which is integrally formed with the member 54. A spring 62 attaches to the member 54 near the joining place of extension 60 and on its other end attaches to plate 48. This biases the member 54 and the tongue 24 attached thereto to the position shown in FIG. 3, that is, the extended position. The member 54 and the tongue 24 are rotated from the position shown in FIG. 3 to the position shown in FIG. 4 as hereinafter described.

Figure 5:
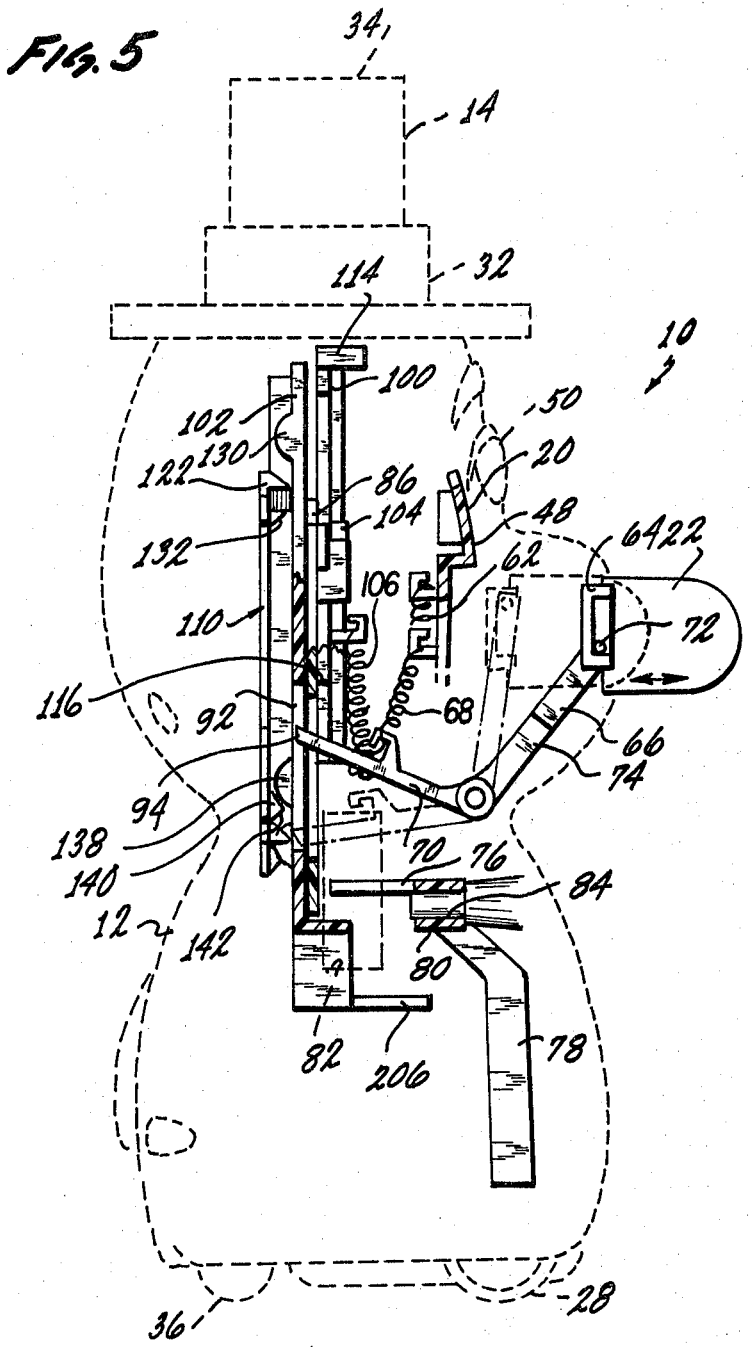
FIG. 5 is a partial side elelvational view of the toy showing the right-hand side of the toy to illustrate certain components in solid line in one spatial relationship and in phantom line in a second spatial relationship.

The nose 22 is semi-ellipsoidal in shape and includes a slotted bracket 64 on its inside end. A bell crank 66 is also pivotally mounted about axle 56 on the far side of member 54 as seen in FIG. 4 or on the near side as seen in FIG. 5 which best describes it. A spring 68 extends between one of the arms 70 of the bell crank 66 to the plate 48 and biases the bell crank to the position shown in solid line in FIG. 5 which causes extension of the nose 22 outside of the body 12. The bell crank 66 is moved to the position shown in phantom in FIG. 5 as hereinafter explained. The bell crank 66 includes an axle 72 on its other arm 74. The axle 72 fits within the slotted bracket 64 on the nose 22. Motion of the bell crank 66 is thus transferred to the nose 22 by the interaction of the axle 72 with the bracket 64.

Figure 7:
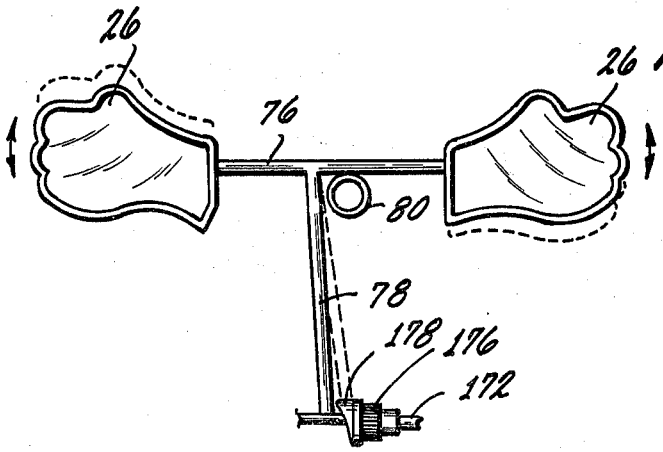
FIG. 7 is a front elevational view showing certain components found in the interior of the toy but hidden from view in FIG. 2.

Referring now to FIGS. 5 and 7 the upper limbs 26 are attached to a horizontally oriented cross bar 76 which has a vertically extending activator bar 78 attached thereto in a perpendicular manner. In the corner wherein the bars 76 and 78 attach, there is a bearing surface 80. The upper limbs 26 are attached to the cross bar 76 and extend outward from the body 12 by being exposed through holes 82, one of which is shown in phantom in FIG. 5. The bearing surface 80 fits over a boss 84 formed on the inside of the body cavity 12. The bearing 80 is freely pivotable about the boss 84 and thus the upper limbs 26 are free to oscillate in an up and down manner when caused to do so by action on the actuator bar 78 as hereinafter described.

Figure 2:
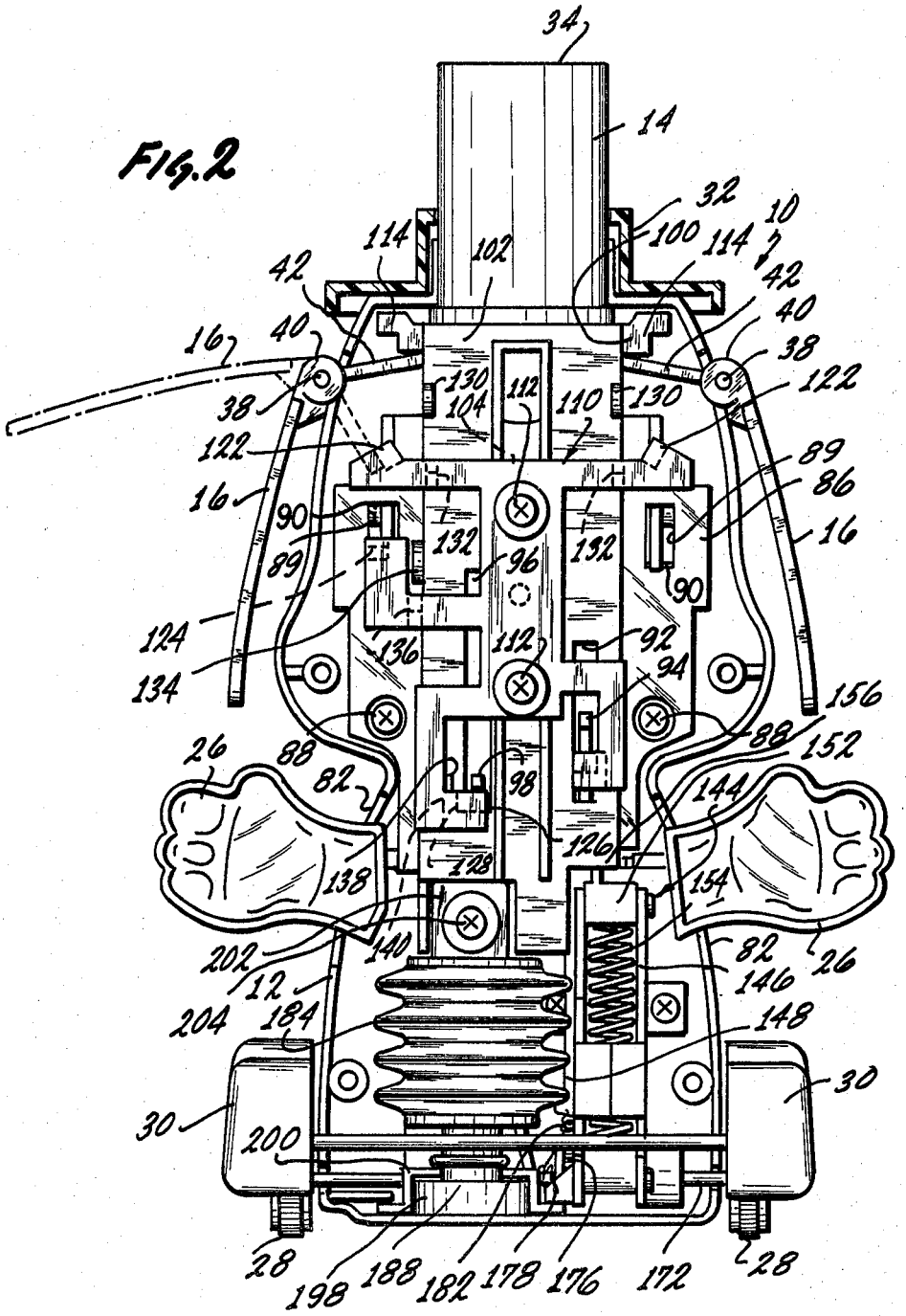
FIG. 2 ia a back elevational view of the toy as seen with the back cover of the toy removed.

A plate 86, the back side of which is seen in FIG. 2, and side views of which are seen in FIGS. 3, 4, and 5 is fixedly attached to the interior of the body 12 by two screws collectively identified by the numeral 89 and shown in FIG. 2. The plate 86 includes cutouts, collectively identified by the numeral 88, which allow for the projection of the end 90 of member 44 through the plate 86. A cutout 92 on the right side of the center of plate 86 as seen in FIG. 2 allows for the projection of end 94 of the arm 74 of bell crank 66 through the plate 86. A cutout 96 on the left-hand side of the center of plate 86 as seen in FIG. 2 allows for the projection of end 98 of extension 60 of the tongue member 54 to project through the plate 86.

Figure 6:
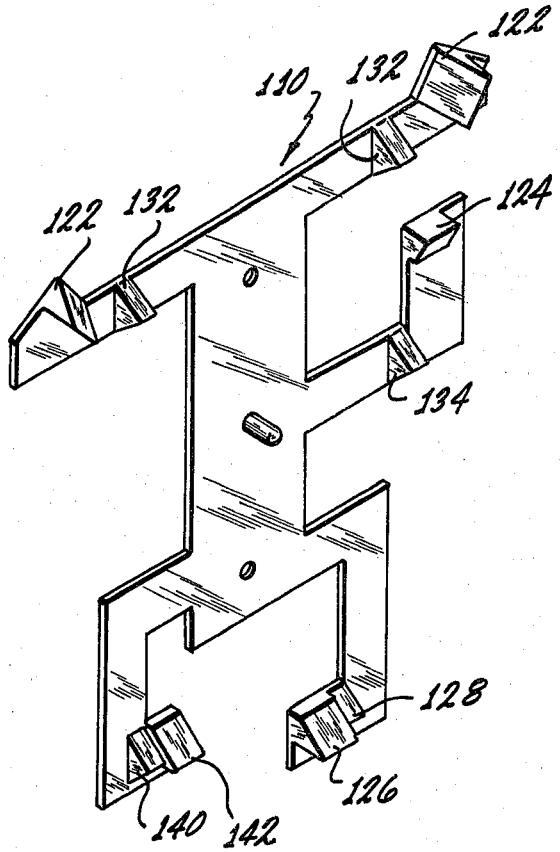
FIG. 6 is an isometric view showing the front view of one of the components, the back of which is seen in FIG. 2.

An inside slidable member 100 fits against one surface of the plate 86 and is slidable thereon. An outside slidable member 102 fits on the other side of plate 86 and is slidable thereon. A holding plate 104 fits over inside slidable member 100 and is attached to plate 86. The holding plate 104 holds inside sliding member 100 against the surface of plate 86, and further serves as an attaching means for one end of spring 106 which extends between the holding plate 104 and the inside slidable member 100. The spring 106 biases the inside slidable member 100 to an upward position. A second spring 108 is also attached to the holding plate at one end and at its other end to the outside slidable member 102. The spring 108 thus biases the outside slidable member 102 to an upward position. Three bosses (not seen or numbered) extend from plate 86 through a cutout (also not seen or numbered) in outside slidable member 102. The cutout rides upon the bosses to keep the outside slidable member 102 sliding in a vertical manner along the plate 86. A spring member 110, seen by itself in FIG. 6 and in position in FIGS. 2, 3, 4 and 5, is attached via two screws collectively identified by the numeral 112 to the aforenoted bosses to fixedly hold both the spring member 110 and the outside slidable member 102 to the plate 86. The plates 86 and 104 and the spring member 110 thus serve as holding and guide members for the inside and outside slidable members 100 and 102. Together, the inside and outside slidable members 100 and 102 can be considered as a primary movable means or movable member within the toy 10. The slidable members 100 and 102 are as previously noted biased in an upward direction by springs 106 and 108, respectively.

The tops of each of the slidable members 100 and 102 fit underneath the activator button 34. When the activator button 34 is depressed within the housing member 32 its downward movement is transferred to the slidable members 100 and 102 biasing them against the tension imparted in the springs 106 and 108 as the springs are stretched. Inside sliding member 100 serves as a setting or activating member to move the ears 16 downwardly, the eyelids 18 upwardly, the nose 22 inwardly, and the tongue 24 inwardly. It accomplishes this as follows. Two tabs, collectively identified by the numeral 114, project to the right and left from the upper surface of the inside slidable member 100. As the inside slidable member 100 descends under the influence of activator button 34 these tabs first engage projections 42 attaching to the ears 16 pushing the projection downwardly and thus the ears outwardly. The tabs 114 then engage the surface of eyelid member 44 pushing said eyelid member downwardly and closing the eyelids 18 over the eyes 20. A shoulder 116 near the bottom of inside slidable member 100 on its right-hand side engages end 80 of arm 70 of the bell crank 66 as the inside slidable member 100 descends. This rotates the bell crank about the axle 56 to withdraw the nose 22 into the interior of the body 12. A finger 118 on the right-hand bottom side of the inside slidable member 100 engages a small tab 120 created at the point where extension 60 attaches to tongue member 54. As the finger 118 descends it pushes the tab 120 and allows for rotation of the member 54 about the axle 56. The members composed of the eyelids 18, the nose 22, and the tongue 24, and the ears 16 are thus moved from an initial position to a subsequent position in direct response to movement of the inside slidable member 100 under the influence of depression of the activator button 34.

Once the members noted in the preceding paragraph are moved from their initial position to their subsequent position, they are held there by interaction of certain detents located on appropriate arms of the spring member 110. Detents, collectively identified by the numeral 122, on the upper part of spring member 110 lock against the ends of the projections 42 attached to the ears 16 holding the ears 16 in an outward position as shown in phantom in FIG. 2. Detent 124 interacts with the end 90 on one of the eyelid members 44 to hold the eyelids 18 in a locked, closed position over the eyes 20. Detent 126 interacts with end 94 on arms 70 of bell crank 66 to hold the nose 22 in a retracted position. Detent 128 interacts with end 98 of extension 60 on the tongue member 54 to hold the tongue in a retracted position.

Outside sliding member 102 includes a plurality of hemispheric tabs numbered below which react with a like plurality of wedges identified below located on the spring member 110. As the outside sliding member 102 slides upwardly as hereinafter explained, the tabs in sequence engage the wedges and sequentially release first the ears 16, then the eyelids 18, followed by the nose 22 and finally the tongue 24. This happens as follows. Two tabs, collectively identified by the numeral 130, interact with wedges collectively identified by the numeral 132 to cause the portion of the spring member 110 wherein detents 122 are located to be pushed outwardly away from the projections 42 attached to the ears 16 to release the ears. A tab 134 next interacts with a wedge 136 to release the eyelids 18, then tab 138 interacts with wedge 140 to release the nose 22, and finally, a tab 140 interacts with wedge 142 to release the tongue 24.

Figure 8:
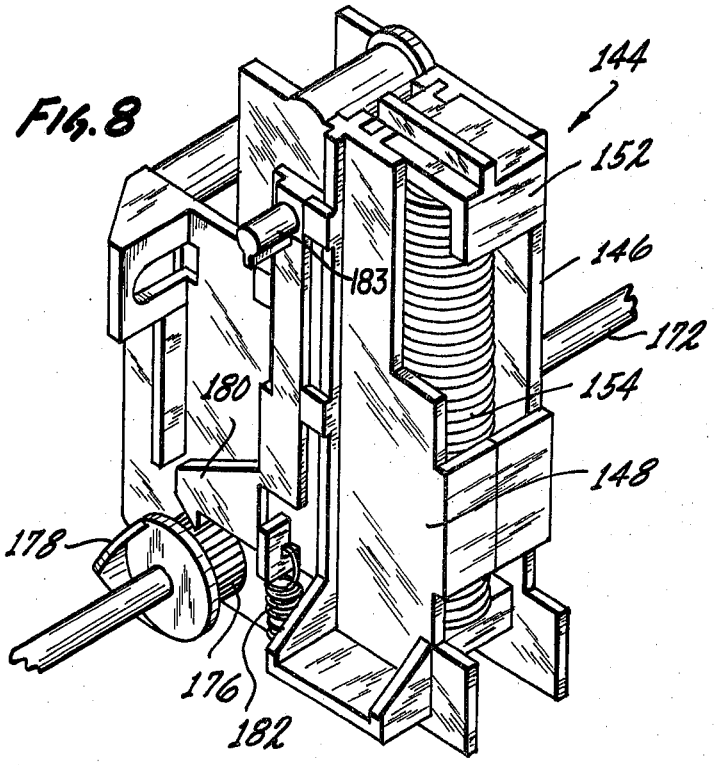
FIG. 8 is an isometric view of a motor mechanism capable of rotating the wheels of the toy shown in FIG. 2, this motor mechanism being located in the lower right-hand corner of FIG. 2.
Figure 9:
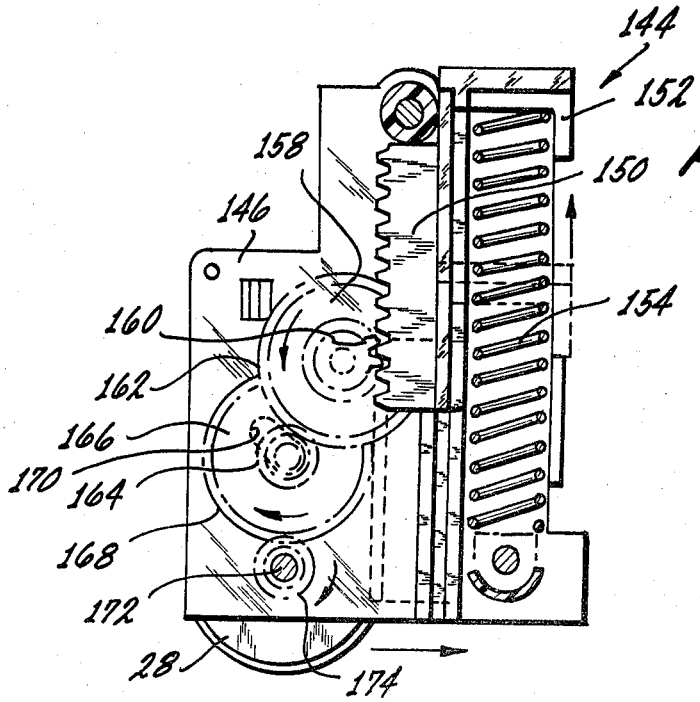
FIG. 9 is a side elevational view in section of certain of the components shown in FIG. 8.

A small spring motor 144 which is seen in isometric in FIG. 8 and in side elevational view in FIG. 9 is located in the bottom right-hand corner of the body 12 of the toy 10 as seen in FIG. 2. The motor 144 has a right and left side housing member 146 and 148 respectively. The housing members 146 and 148 are appropriately connected together with screws (not seen or numbered in the figures). A gear rack 150 is appropriately slidably mounted between the two housing members 146 and 148 to allow it to freely slide in a vertical manner. A projection 152 extends horizontally from the top of the gear rack 150. A compression spring 154 is located between the projection 152 and the bottom of housing members 146 and 148. Depression of the projection 152 thus simultaneously compresses the spring 154 and moves the gear rack 150 downwardly. The projection 152, when the motor 144 is mounted within the body 12 of the toy 10, is positioned to interact with shoulder 156 on outside sliding member 102. Because of this interaction, as outside sliding member 102 is depressed downwardly, ultimately under the influence of actuator button 34, the projection 152 moves downwardly and consequently compresses the spring 154 and moves the gear rack 150 as it travels. A compound gear 158 has pinion teeth 160 and spur teeth 162 located thereon. The pinion teeth 160 engage with and are rotated by the gear rack 150. The spur teeth 162 engage pinion teeth 164 formed on swing gear 166. The swing gear 166 also includes spur teeth 168. Two slots 170, one formed in housing member 146 and one formed in housing member 148 (only one being shown in FIG. 9) allow for movement of swing gear 166. When gear rack 150 descends downwardly it rotates gear 158 clockwise. This in turn rotates swing gear 166 counterclockwise. Counterclockwise rotation of swing gear 166 tends to cause it to rotate upwardly in the slots around the outer periphery of gear 158. Thus, downward motion of the gear rack 150 results in upward motion of swing gear 166. The exact opposite, that is, upward motion of gear rack 150, causes downward motion of swing gear 166.

Located below swing gear 166 is an axle 172. Fixedly located on the axle 172 is a pinion 174. When swing gear 166 is located downwardly in slots 170 its spur teeth 168 engage the pinion 174 and can cause rotation of axle 172. When swing gear 166 is moved upwardly in the slots 170 the spur teeth 168 come free of pinion 174 and no rotation is transferred to axle 172.

As noted before, shoulder 156 on the bottom of outside sliding member 102 engages the projection 152. As the outside sliding member 102 is pushed downwardly under the influence of activation button 34 the compression spring 154 is compressed and ultimately the swing gear 166 is turned counterclockwise and rides upwardly within slots 170, thus not transmitting any motion to pinion 174 and thus axle 172.

Axle 172 extends clear across the width of the body 12 and projects outwardly from both sides of the body. The drive wheels 28 are appropriately mounted on the ends of axle 172. Immediately adjacent to housing member 148 and freely mounted on axle 172 is a pinion 176. A slip clutch (not shown in the figures) engages pinion 176 with axle 172 and thus allows transfer of motion from axle 172 to pinion 176, but protects the internal mechanism of the motor 144 from damage should the child using the toy turn the drive wheels 28 by hand or by frictionally engaging a surface. A cam 178 as seen in FIG. 7 is mounted on the side of pinion 176 and rotates with pinion 176. Rotation of the axle 172 simultaneously causes rotation of drive wheels 28 and of cam 178. Rotation of the cam 178 by virtue of interaction of the cam 178 with the activator bar 78 causes oscillatory movement of the upper limbs 26.

Slidably mounted on the side of housing member 148 is a ratchet 180. The ratchet 180 is biased downwardly via a spring 182. The ratchet 180 engages the pinion 176. Ratchet 180 has the ability of locking the axle 172 and thus ultimately the position of the compression spring 154 and projection 152 from movement. Once the compression spring 154 is compressed via downward movement of the outside sliding member 102 it is maintained in this compressed or activated state by the locking action of ratchet 180 with the pinion 176.

A bellows 184 is formed such that it has an imperforate body completely sealed except for an opening 186 on one end thereof. The opening 186 accepts a small nipple 188 which has a small opening or channel 190 located therein. The opening 190 therefore serves as the only ingress and egress opening for fluid movement into and out of the interior of the bellows 184. Formed as part of the nipple 188 is a flange 192. The flange 192 has a planar surface 194 completely surrounding the periphery of the opening 190. The surface 194 contains a large plurality of convolutions; i.e., it is a rough surface. A diaphragm 196 which is flexible fits against the surface 194. Because the surface 194 is convoluted or rough the diaphragm 196 cannot form a perfect seal against it. If the bellows 184 is compressed as seen in FIG. 4 a suction is created within the interior of the bellows and within the opening 190. This suction pulls the diaphragm 196 against the surface 194.

Because the surface 194 is roughened or convoluted, it cannot form a perfect seal with the diaphragm 196. As a consequence, therefore, fluid—i.e., air—can slowly flow into the interior of the bellows 184 between the surface 194 and the diaphragm 196. The diaphragm 196 is held against the surface 194 by the presence of an annular holding member 198 which is fixedly attached to the nipple 188. A U-shaped bracket 200 is fixedly mounted to the bottom of the interior of the body 12. The holding member 198 fits within the U-shaped bracket 200 and fixedly retains the bracket, and as a consequence, the nipple 188 and one end of the bellows 184 in a fixed position against the bottom of the body 12.

The other end of the bellows 184 contains an attaching tab 202. The attaching tab 202 is fixedly attached to the bottom of outside sliding member 102 by screw 204. Downward movement of the outside sliding member 102 is transferred to the bellows 184 compressing the same and voiding its interior of air or other fluid. Upward movement of the outside slidable member 102, however, is inhibited by the vacuum created within the interior of bellows 184. This vacuum, however, is not perfect as described above because of the fluid leakage between the surface 194 and the diaphragm 196. This fluid leakage allows for slow expansion of the bellows 184 and, as a consequence, slow movement of the outside sliding member 102 in an upward direction under the influence of spring 108 which was noted above to bias the outside sliding member 102 in an upward direction. After depression of the outside sliding member 102 it ultimately will once again slide into its uppermost position under the bias of spring 108; however, the velocity of its sliding motion is governed by the presence of bellows 184 which extends between the bottom of the sliding member 102 and the bottom of the body 12.

As noted in FIGS. 3, 4 and 5 fixedly attached to the bottom of outside sliding member 102 is a horizontally projecting tab 206. The release tab 183 located on the side of ratchet 180 fits above the tab 206 and is in line with the tab 206. After the outside sliding member 102 is depressed and has once again started travelling upwardly under the governing action of the bellows 184, it ultimately nears its final upward position. At this time the tab 206 approaches and engages the release tab 182 on the ratchet 180. The engagement of the tab 206 with the release tab 183 slides the release tab 183 upwardly which in turn slides the ratchet 180 upwardly. This frees the locking action between the ratchet 180 and the pinion 176 allowing expression of the compressed energy in spring 154 to be transferred via gears 158, 166 and 174 to the axle 172. The extension of the compression spring 154 therefore causes rotation of the axle 172 which in turn causes rotation of the drive wheels 28. Accompanying rotation of the drive wheels 28 is rotation of the pinion 176 and the cam 178 attached thereto, which causes oscillation of the upper limbs 26.

The drive wheels 28 are eccentrically mounted on the ends of the axle 172 such that as they rotate the toy 10 is caused to rock back and forth and additionally since the lower limbs 30 are positioned directly over and in fact right on the surface of the drive wheels 28, the lower limbs 30 are caused to oscillate up and down in response to the eccentric motion of the drive wheels 28.

Compression of the compression spring 54 is prevented from being transferred to the axle 172 by the presence of swing gear 66 while extension of the compression spring 154 is directly transferred into rotation of the axle 172 and motion of the toy 10.

The downward movement of the inside slidable member 100 was noted above to cause movement of the ears, eyes, nose and tongue. The downward movement of the outside slidable member 102 is noted to cause compression of the compression spring 104. The upward movement of the outside slidable member 102 sequentially causes the reverse movement of the tongue, nose, eyelids, ears and finally rotation of the drive wheels 28 and the upper and lower limbs 26 and 30.

We claim:

1. A toy which comprises:

a housing;

a primary moving means mounted on said housing and movable between a first position and a second position;

a first means operatively associated with said primary moving means and capable of moving said primary movable means from said first position to said second position:

a second means and a rectilinearly movable governing means both operatively associated with said primary movable means, said second means capable of moving said primary movable means from said second position to said first position and concurrently said governing means governing the rate of movement of said primary movable means from said second position to said first position, said second means structurally distinct from said first means, said governing means structurallly distinct from said second means;

at least one secondary movable means mounted on said housing in operative association with said primary movable means and said first means, said secondary movable means movable from an initial position to a subsequent position in association with movement of said primary movable means from its first position to its second position and from said subsequent position to said initial position in response to movement of said primary moving means from its second position to its first position.

2. The toy of claim 1 wherein:

said second means includes a biasing means capable of moving said primary movable means from said second position to said first position.

3. The toy of claim 2 including:

at least two secondary movable means mounted on said housing, each of said secondary movable means operatively associated with said primary movable means and said first means, each of said secondary movable means movable from an initial position to a subsequent position in association with movement of said primary movable means from its first position to its second position, each of said secondary movable means independently and sequentially moving from said subsequent position to said initial position in response to movement of said primary movable means from its second position to its first position.

4. The toy of claim 3 wherein:

said governing means includes a bellows means having an imperforate expandable bellows body, said bellows body including attaching means located on opposite ends of said bellows body, said attaching means on one end of said bellows body attaching said bellows body to said housing and said attaching means on the other end of said bellows body attaching said bellows body in operative association with said primary movable means, said bellows means including an opening, said opening connecting the interior of said bellows body to the ambient environment within said housing, said opening having a surface positioned around the total periphery of said opening, said surface including a large multiplicity of irregular convolutions, a flexible diaphragm positioned in direct association with said surface and partially sealable against the convolutions on said surface so as to allow passage of fluid into said bellows body by passing said fluid between said surface and said diaphragm at a controlled rate depending upon the size and placement of said convolutions on said surface.

5. The toy of claim 4 wherein:

said first means further comprises actuator means movably mounted on said housing, at least a portion of said actuator means exposed outside of said housing in a position such that at least said portion is capable of being engaged by the operator of said toy and motion imparted to said actuator means by the operator of the toy, said actuator means capable of engaging said primary movable means and causing said primary movable means to move from said first position to said second position in response to motion imparted to said actuator means by the operator of said toy.

6. The toy of claim 5 wherein:

at least one of said secondary movable means comprises a movably extendable member movably mounted on said housing, said extendable member moving on said housing with respect to the outside of said housing between an extended position corresponding to said initial position and a retracted position corresponding to said subsequent position.

7. The toy of claim 6 wherein: said primary movable means is linearly movable within said housing.

8. The toy of claim 7 wherein:

said primary movable means further comprises at least one slidable member movable within said housing;

said actuator means further comprises an actuator button, a portion of which is exposed outside of said housing, said actuator button capable of abutting against said slidable member to linearly move said member within said housing;

said biasing means further comprises a spring means operatively associated with said slidable member and capable of sliding said slidable member from said second position to said first position.

9. A device for governing the rate of movement of two members which are movable with respect to one another which comprises:

a body having a first portion, a second portion and an interior, said first portion of said body connecting to and moving in conjunction with one of said movable members and said second portion of said body connecting to and moving in conjunction with the other of said two movable members, said first and said second portion of said body movable with respect to each other between at least a first position and a second position in response to movement of said two members with respect to one another, said interior of said body having a first volume when said first and said second portions of said body are in their first position and a second volume when said first and said second portions of said body are in their second position;

said body including an opening into the interior of said body, said opening being capable of conducting a fluid in to and out of the interior of said body, fluid moving into said body in response to a change in the volume of the interior of said first body from said first volume to said second volume;

a roughened surface associated with said body and surrounding the periphery of said opening;

a diaphragm located in association with said roughened surface and capable of partially sealing against said roughened surface and when said diaphragm is partially sealed against said roughened surface said partial seal between said diaphragm and said roughened surface governing the rate of fluid movement into the interior of said body, said rate of movement into said interior of said body governing the rate of change of the volume of said interior of said body from said first volume to said second volume which in turn governs the rate of movement of said first portion and said second portion of said body and said members attached thereto;

said body being a bellows;

said diaphragm being a flexible diaphragm and including holding means movably locating said flexible diaphragm in association with said surface.

10. A device for governing the rate of movement of two members which are movable with respect to one another which comprises:

a hollow body having a first portion, a second portion and a permanently enclosed interior extending between said first and said second portions, said first portion of said body connecting to and moving in conjunction with one of said movable members and said second portion of said body connecting to and moving in conjunction with the other of said two movable members, said first and said second portions of said body movable with respect to each other between at least a first position and a second position in response to movement of said two members with respect to one another, said interior of said body having a first volume when said first and said second portions of said body are in their first position and a second volume when said first and said second portions of said body are in their second position;

said body including an opening into the interior of said body, said opening being capable of conducting a fluid in to and out of the interior of said body, fluid moving into said body in response to a change in the volume of the interior of said body from said first volume to said second volume and out of said body in response to a change in the interior of said body from said second volume to said first volume;

a roughened surface associated with said body and surrounding the periphery of said opening;

a diaphragm located in association with said roughened surface and capable of partially sealing against said roughened surface and when said diaphragm is partially sealed against said roughened surface said partial seal between said diaphragm and said roughened surface governing the rate of fluid movement into said interior of said body, said rate of fluid movement into said interior of said body governing the rate of change of the volume of said interior of said body from said first volume to said second volume which in turn governs the rate of movement of said first portion and said second portion of said body and said members attached thereto.

* * * * *